US010070491B2

(12) United States Patent
DeNicholas et al.

(10) Patent No.: US 10,070,491 B2
(45) Date of Patent: Sep. 4, 2018

(54) LED BYPASS AND CONTROL CIRCUIT FOR FAULT TOLERANT LED SYSTEMS

(71) Applicant: Texas Instruments Incorporated, Dallas, TX (US)

(72) Inventors: Joseph V. DeNicholas, Longmont, CO (US); Perry Tsao, Sunnyvale, CA (US); Christoph Goeltner, Cupertino, CA (US); Daniel Ross Herrington, Fort Collins, CO (US); James Masson, Boulder, CO (US); James Patterson, Lafayette, CO (US); Werner Berns, Grasbrunn (DE)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 14/957,052

(22) Filed: Dec. 2, 2015

(65) Prior Publication Data

US 2016/0088699 A1 Mar. 24, 2016

Related U.S. Application Data

(62) Division of application No. 13/871,917, filed on Apr. 26, 2013, now Pat. No. 9,253,850.

(Continued)

(51) Int. Cl.
*H05B 37/02* (2006.01)
*H05B 33/08* (2006.01)

(52) U.S. Cl.
CPC ..... *H05B 33/0845* (2013.01); *H05B 33/083* (2013.01); *H05B 33/089* (2013.01); *H05B 33/0815* (2013.01); *Y10T 307/76* (2015.04)

(58) Field of Classification Search
CPC ..... H05B 33/0815; H05B 33/0845; H05B 33/083; H05B 33/089; Y10T 307/76
See application file for complete search history.

(56) References Cited

U.S. PATENT DOCUMENTS 3,706,914 A * 12/1972 Van Buren ..... H05B 37/029 315/291
8,093,826 B1 1/2012 Eagar et al.
(Continued)

FOREIGN PATENT DOCUMENTS

CN 101686591 A 3/2010
CN 102026438 A 4/2011
CN 102287785 A 12/2011

OTHER PUBLICATIONS

Notification of First Office Action for Chinese Patent Application 201310191505.6, dated Jun. 29, 2016 (4 pages).
(Continued)

*Primary Examiner* — Don Le
(74) *Attorney, Agent, or Firm* — William B. Kempler; Charles A. Brill; Frank D. Cimino

(57) ABSTRACT

A light system (FIG. 2) is disclosed. The light system includes a plurality of series connected light emitting diodes (240-246). Each of a plurality of switching devices (230-236) has a control terminal and each has a current path coupled in parallel with a respective LED. A plurality of fault detector circuits (220-226) are each coupled in parallel with a respective light emitting diode. Each fault detector circuit has a first comparator (FIG. 7, 704) arranged to compare a voltage across the respective light emitting diode to a respective first reference voltage (708). When a fault is detected, a control signal is applied to the control terminal to turn on a respective switching device of the plurality of switching devices.

13 Claims, 7 Drawing Sheets

Related U.S. Application Data

(60) Provisional application No. 61/650,099, filed on May 22, 2012.

(56) References Cited

U.S. PATENT DOCUMENTS

| | | | | |
|---|---|---|---|---|
| 8,354,799 | B2 | 1/2013 | Yang et al. | |
| 8,536,896 | B1 * | 9/2013 | Trimberger | H03K 19/17736 326/38 |
| 8,643,284 | B2 | 2/2014 | Welten | |
| 8,710,757 | B2 | 4/2014 | Welten | |
| 8,773,038 | B2 | 7/2014 | Logiudice | |
| 8,872,440 | B2 | 10/2014 | Xi et al. | |
| 9,077,206 | B2 * | 7/2015 | Zhang | H02J 3/383 |
| 9,253,850 | B2 | 2/2016 | DeNicholas et al. | |
| 2004/0155676 | A1 * | 8/2004 | Kaptanoglu | H03K 19/17728 326/38 |
| 2005/0134188 | A1 * | 6/2005 | Lindqvist | H05B 41/3921 315/149 |
| 2005/0242836 | A1 * | 11/2005 | Goetting | G01R 31/3167 326/39 |
| 2007/0188427 | A1 * | 8/2007 | Lys | H05B 33/0815 345/82 |
| 2010/0027720 | A1 | 2/2010 | Akahori | |
| 2012/0299483 | A1 | 11/2012 | Lethellier | |
| 2014/0247432 | A1 | 9/2014 | Yanase | |
| 2015/0061505 | A1 * | 3/2015 | Asami | H05B 37/0218 315/152 |

OTHER PUBLICATIONS

Notification of Third Office Action and English Translation of the Office Action from Chinese Patent Application No. 201310191505.6, dated Jan. 22, 2018 (6 pages).
English Machine Translation for CN102287785A (5 pages).

* cited by examiner

| ADDR | REGISTER SET |
|---|---|
| 00h - 0Eh | LED1 ON REGISTERS (MAP 1) |
| 20h - 2Eh | LED1 OFF REGISTERS (MAP 1) |
| 40h - 4Eh | LED1 ON REGISTERS (MAP 2) |
| 4Fh - 5Dh | LED1 OFF REGISTERS (MAP 2) |
| B0h - B3h | ENABLE REGISTERS |
| C0h - C5h | CONTROL REGISTERS |
| E0h - C2h | DIAGNOSTIC REGISTERS |

| ADDR | REGISTER | DATA BITS [7:0] | | | |
|---|---|---|---|---|---|
| 00h | LED1 ON (LSB) | LED1 ON [7:0] | | | |
| 01h | LED2 ON (LSB) | LED2 ON [7:0] | | | |
| 02h | LED3 ON (LSB) | LED3 ON [7:0] | | | |
| 03h | LED4 ON (LSB) | LED4 ON [7:0] | | | |
| 04h | LED1-4 ON (MSB) | LED4 ON [9:8] | LED3 ON [9:8] | LED2 ON [9:8] | LED1 ON [9:8] |

FIG. 9A

| ADDR | REGISTER | DATA BITS [7:0] | | | |
|---|---|---|---|---|---|
| 20h | LED1 OFF (LSB) | LED1 OFF [7:0] | | | |
| 21h | LED2 OFF (LSB) | LED2 OFF [7:0] | | | |
| 22h | LED3 OFF (LSB) | LED3 OFF [7:0] | | | |
| 23h | LED4 OFF (LSB) | LED4 OFF [7:0] | | | |
| 24h | LED1-4 OFF (MSB) | LED4 OFF [9:8] | LED3 OFF [9:8] | LED2 OFF [9:8] | LED1 OFF [9:8] |

FIG. 9B

LED BYPASS AND CONTROL CIRCUIT FOR FAULT TOLERANT LED SYSTEMS

CROSS-REFERENCE TO RELATED APPLICATIONS

This application is a divisional of U.S. Nonprovisional application Ser. No. 13/871,917, filed Apr. 26, 2013, which claims the benefit under 35 U.S.C. §119(e) of U.S. Provisional Appl. No. 61/650,099, filed May 22, 2012, which are incorporated herein by reference in their entirety

BACKGROUND

Embodiments of the present invention relate to a light emitting diode (LED) bypass and control circuit for fault tolerant LED lighting systems.

Light emitting diode (LED) lighting systems are presently used for many applications such as automobiles, homes, businesses, and security systems. LED lighting systems to provide illumination more efficiently than incandescent lighting systems, since they expend much less power in heat generation and are much more reliable. LED lighting systems are also much more flexible than fluorescent lighting systems, since they are more tolerant to environmental conditions such as shock, contamination, and temperature. Moreover, they may be operated with controlled duty cycles to adjust brightness. LED lighting systems are often configured as series-connected LEDs due to their relatively small forward voltage. As such, the series connection or string of LEDs is susceptible to failure if any LED in the string fails open.

While preceding approaches have provided steady improvements in LED lighting systems, the present inventors recognize that still further improvements are possible. Accordingly, the preferred embodiments described below are directed toward improving upon the prior art.

BRIEF SUMMARY OF THE INVENTION

In a preferred embodiment of the present invention, a light system is disclosed. The light system includes a plurality of series connected light emitting diodes. Each of a plurality of transistors has a control terminal and has a current path coupled in parallel with a respective light emitting diode. The light system includes a fault detector circuit coupled in parallel with each respective light emitting diode. Each fault detector circuit has a first comparator arranged to compare a voltage across the respective light emitting diode to a respective first reference voltage.

Another embodiment provides a register circuit having a first subset comprising ON registers, a second subset comprising OFF registers, and a logic circuit. The logic circuit arrange to select the first subset in response to a first sequence of K address signals, and to select a first part of the first subset and a first part of the second subset in response to a second sequence of K address signals.

Another embodiment provides a method of operating a light system comprising writing data in a first set of registers, writing data in a second set of registers, incrementing a count in a first counter, and turning LEDs on or off based on contents of the registers and counter.

BRIEF DESCRIPTION OF THE DRAWINGS

FIG. 9A is a memory map showing a write sequence of input LED On registers according to the present invention;

FIG. 9B is a memory map showing a write sequence of input LED Off registers according to the present invention;

DETAILED DESCRIPTION

The preferred embodiments of the present invention provide significant advantages over LED lighting systems of the prior art as will become evident from the following detailed description.

Figure 1:
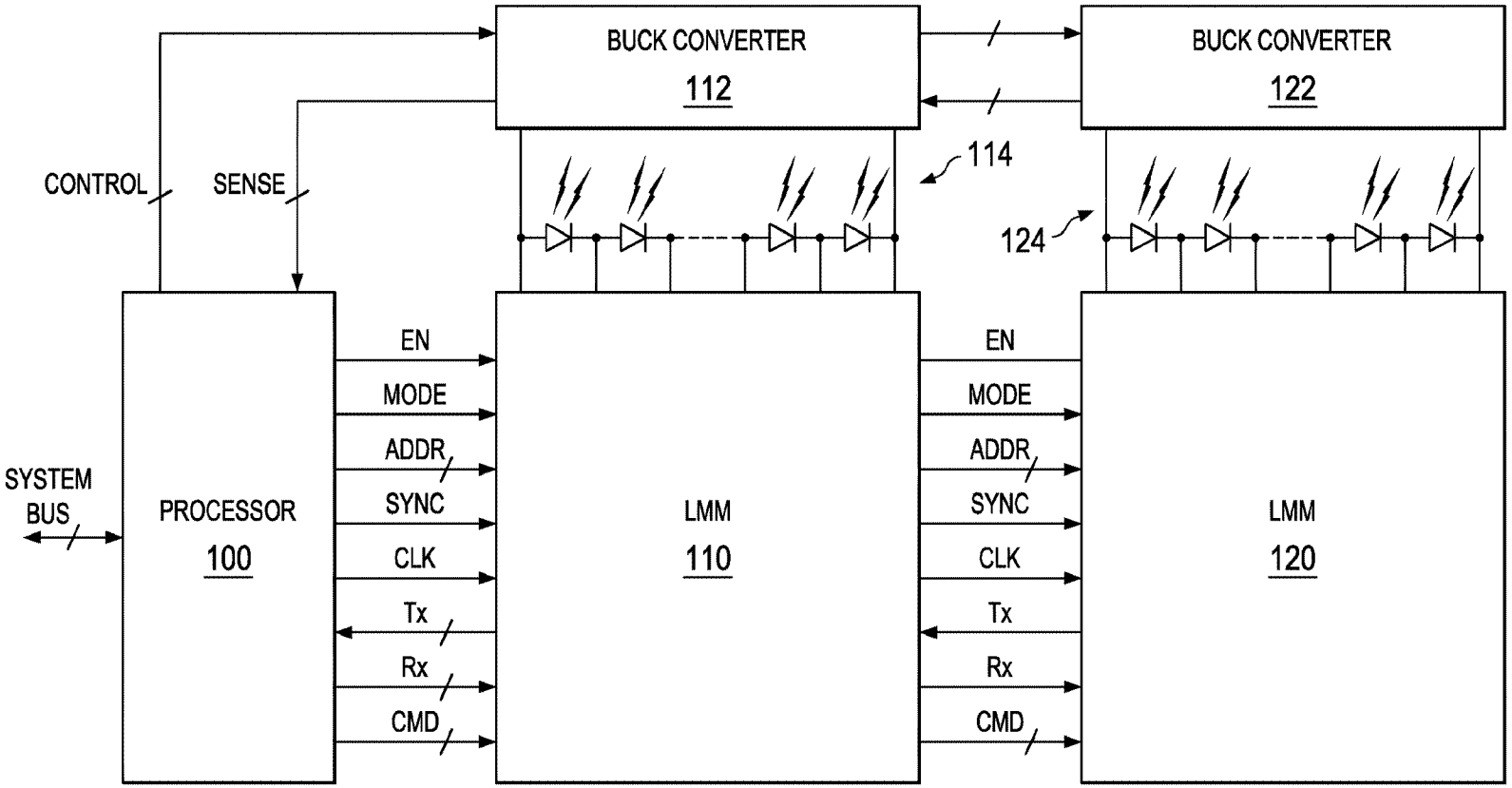
FIG. 1 is a LED lighting system according to the present invention.

Referring to FIG. 1, there is a LED lighting system of the present invention which may be used for automotive lighting, home lighting, security lighting, or other applications where fault tolerant operation is desirable. The lighting system includes a processor 100 which is preferably coupled to a system bus to receive control signals. The processor 100 is coupled to LED Matrix Manager (LMM) circuits 110 and 120 to provide enable (EN), synchronization (SYNC) and clock (CLK) signals. The processor 100 and the LMM circuits 110 and 120 include universal asynchronous receiver/transmitter (UART) circuits and communicate via transmit (Tx) and receive (Rx) signal lines. Synchronization signal SYNC synchronizes all PWM counters 400 (FIG. 4) of each LMM. Mode signal MODE determines whether processor 100 communicates with LMM circuits 110 and 120 by UART or Serial Peripheral Interface (SPI) protocol. The processor 100 may also be coupled to other LMMs (not shown) that are separately addressed from LMM 110 and 120. Each of LMM circuits 110 and 120 receive command signals over a command bus (CMD) and are addressed by the most significant address bits of address bus ADDR. Alternatively, each of LMM circuits 110 and 120 may be simultaneously addressed by a broadcast write command that ignores the most significant address bits and writes the same data to each LMM in parallel. The processor 100 is also coupled to DC-DC switching regulator or buck converter circuits 112 and 122 to provide control signals and to sense operation. There are many suitable buck converter designs that may be used with the present invention such as PFET Buck Controller LM3409 by National Semiconductor™ (2010). Buck converter 112 supplies current to a first string of series connected LEDs 114 which is coupled to LMM 110. Likewise, buck converter 122 supplies current to a second string of series connected LEDs 124 which is coupled to LMM 120.

Figure 2:
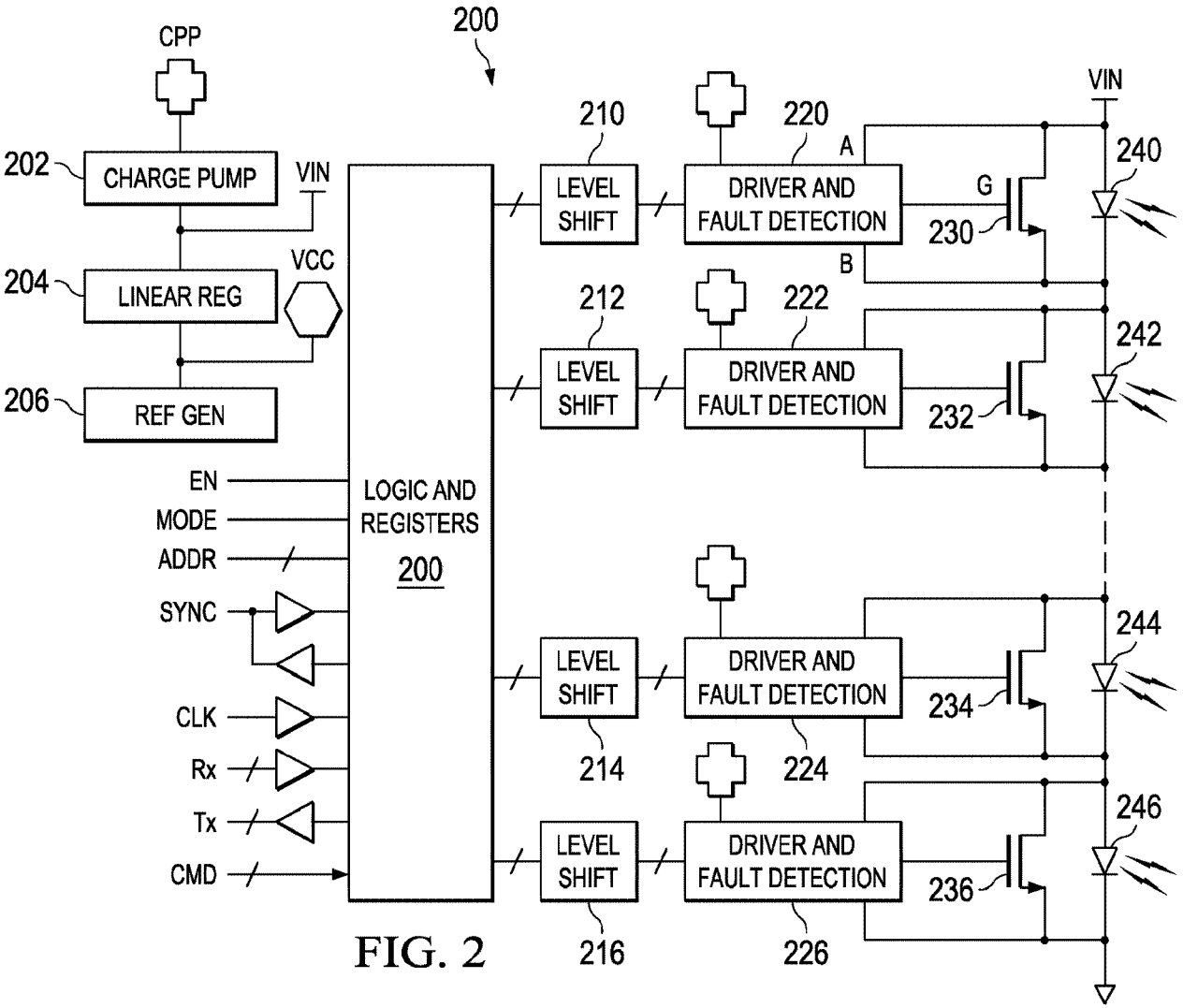
FIG. 2 is a circuit diagram of LED Matrix Manager (LMM) circuit 110 of FIG. 1 coupled to series connected LEDs.

Referring now to FIG. 2, there is a circuit diagram of LED Matrix Manager (LMM) circuit 110 of FIG. 1 coupled to a string of series connected LEDs 240 through 246. LMM 120 is substantially the same as LMM 110. LMM 110 includes a charge pump 202 to provide an output voltage CPP greater than VIN, a linear voltage regulator 204, and a reference voltage generator 206. Block 200 includes the UART, control logic and control registers as will be explained in detail. The LMM also includes multiple LED drive circuits. Each drive circuit, for example the top drive circuit, includes a level shift circuit 210, driver and fault detector circuit 220, and n-channel transistor 230. In alternative embodiments of the present invention, n-channel transistor 230 may also be a bipolar transistor, a semiconductor controlled rectifier (SCR), or any other suitable switching device as is known in the art. Furthermore, although LED 240 is shown as a single LED, each of LEDs 240 through 246 may be a small cluster of 2-5 series connected LEDs.

Figure 3:
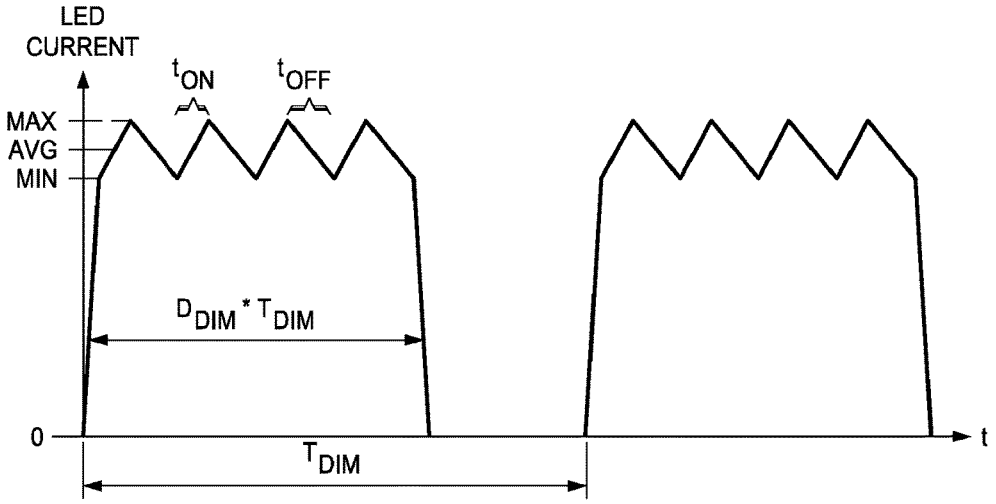
FIG. 3 is a timing diagram showing modulation of the LED brightness of FIG. 2 by duty cycle control.

Turning now to FIG. 3, there is a timing diagram showing modulation of the brightness of LED 240 of FIG. 2 by duty cycle control. Here, the horizontal axis is time and the vertical axis is current through LED 240. Current from buck converter 112 (FIG. 1) is regulated between minimum (MIN) and maximum (MAX) values to produce an average (AVG) LED current. This is accomplished by alternately turning on a drive transistor (not shown) of the buck converter for time $t_{ON}$ and turning off the drive transistor for time $t_{OFF}$. The average LED current remains relatively constant and brightness of the LED is controlled by modulating the duty cycle $D_{DIM}$, which is a percentage of time period $T_{DIM}$. Thus, minimum LED brightness occurs as $D_{DIM}$ approaches 0% and maximum LED brightness occurs as $D_{DIM}$ approaches 100%.

Figure 4:
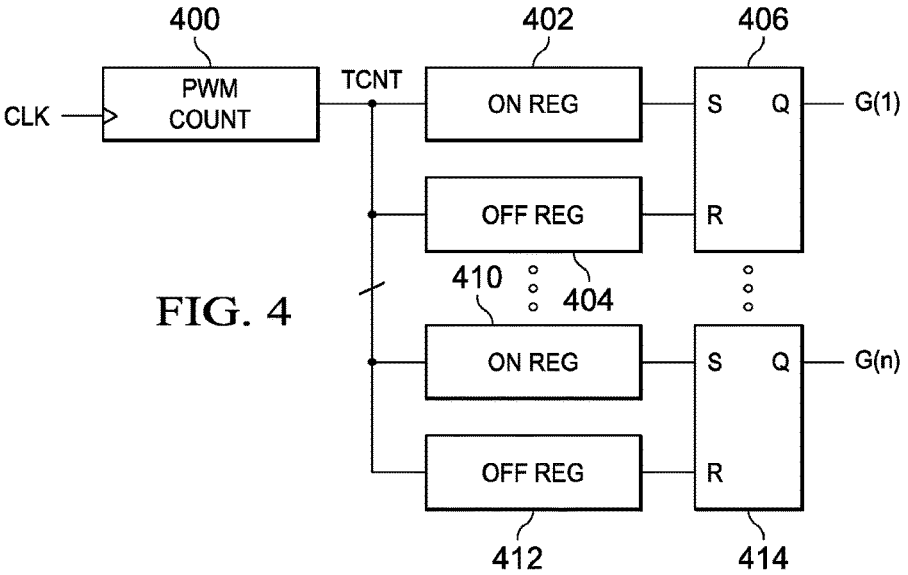
FIG. 4 is a circuit simplified diagram of registers in block 200 of FIG. 2.

Referring next to FIG. 4, there is a simplified circuit diagram of registers in block 200 of FIG. 2. Block 200 includes Pulse Width Modulation (PWM) counter 400 and produces counter output signal TCNT. In a preferred embodiment of the present invention, PWM counter 400 is a 10-bit counter that continually counts from 0 to 1023. On overflow, PWM counter 400 repeats the counting sequence from 0 to 1023. In an alternative embodiment of the present invention, PWM counter 400 is a 14-bit counter that divides a 6.4 MHz clock signal CLK by 16 to produce a 400 KHz TCNT signal in the ten most significant bits of the counter. One of ordinary skill in the art having access to the instant specification, however, will understand that many alternative operating frequencies of CLK and TCNT are possible for various applications. PWM counter 400 supplies count TCNT to On registers 402 and 410 and to Off registers 404 and 412. Each pair of On and Off registers corresponds to a respective LED drive circuit of FIG. 2. For example, On register 402 and Off register 404 correspond to the top LED drive circuit (210, 220, and 230) of FIG. 2. Each pair of On and Off registers is further coupled to a respective SR flip flop. For example, registers 402 and 404 are coupled to SR flip flop 406, and registers 410 and 412 are coupled to SR flip flop 414.

Figure 5:
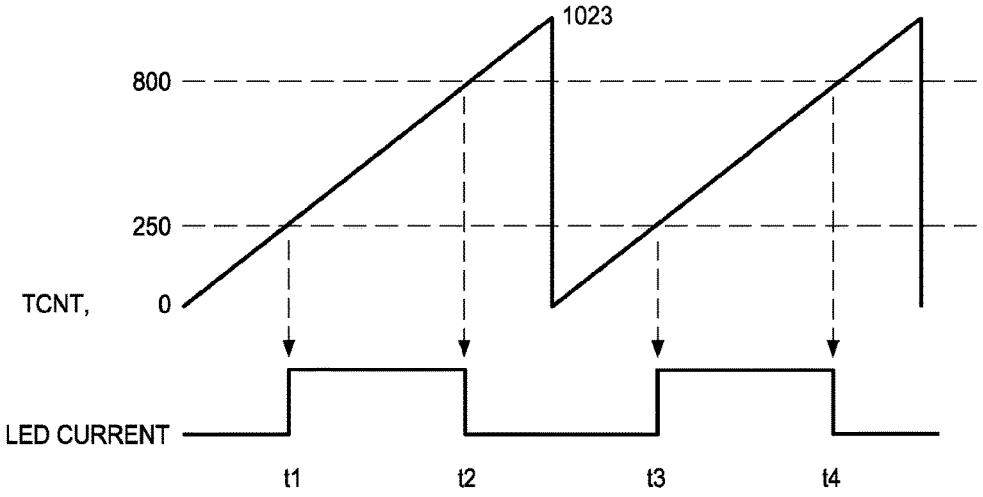
FIG. 5 is a timing diagram showing brightness control of an individual LED of FIG. 2.

In operation, processor 100 communicates via UART or SPI with block 200 to initially load each On register with a respective On count. Likewise, processor 100 also directs loading each Off register with a respective Off count. The timing diagram of FIG. 5 illustrates operation of the circuit FIG. 4 when On register 402 is loaded with a value of 250 and Off register 404 is loaded with a value of 800. The horizontal axis of FIG. 5 represents time. TCNT begins at count 0 and LED current is initially 0. TCNT incrementally increases to 250 at time t1 in response to clock signal CLK. At time t1 On register 402 matches TCNT and sets SR flip flop to produce a high level of gate signal G(1). This high level of gate signal G(1) causes current to flow through respective LED 240 as will be explained in detail. PWM counter 400 continues to count and TCNT reaches 800 at time t2. At time t2, therefore, Off register 404 matches TCNT and resets SR flip flop to produce a low level of gate signal G(1). This low level of gate signal G(1) terminates current flow through respective LED 240. PWM counter 400 continues to count and returns to 0 on overflow. Then at time t3, TCNT again reaches 250 and matches the value of On register 402. This again sets SR flip flop to produce a high level of gate signal G(1) with resulting current flow through respective LED 240. TCNT continues to incrementally increase and reaches 800 at time t4. At time t4, therefore, Off register 404 again matches the count TCNT and resets SR flip flop to produce a low level of gate signal G(1), thereby terminating current flow through respective LED 240. Although the Off count 800 in the foregoing example is greater than the On count, it should be understood that the Off count may also be less than the On count. For example, if the Off count is 100 LED 240 begins to conduct current when TCNT reaches 250 and continues to conduct current until TCNT wraps around and reaches 100. As previously explained, when TCNT matches Off register 404 a resulting low level of gate signal G(1) terminates current flow through LED 240.

The register control system of FIG. 4 is highly advantageous in providing a means to control brightness each LED in a string of series connected LEDs. This provides precise control of light distribution and beam forming for automotive, home, security, small business, and other lighting applications.

Figure 6:
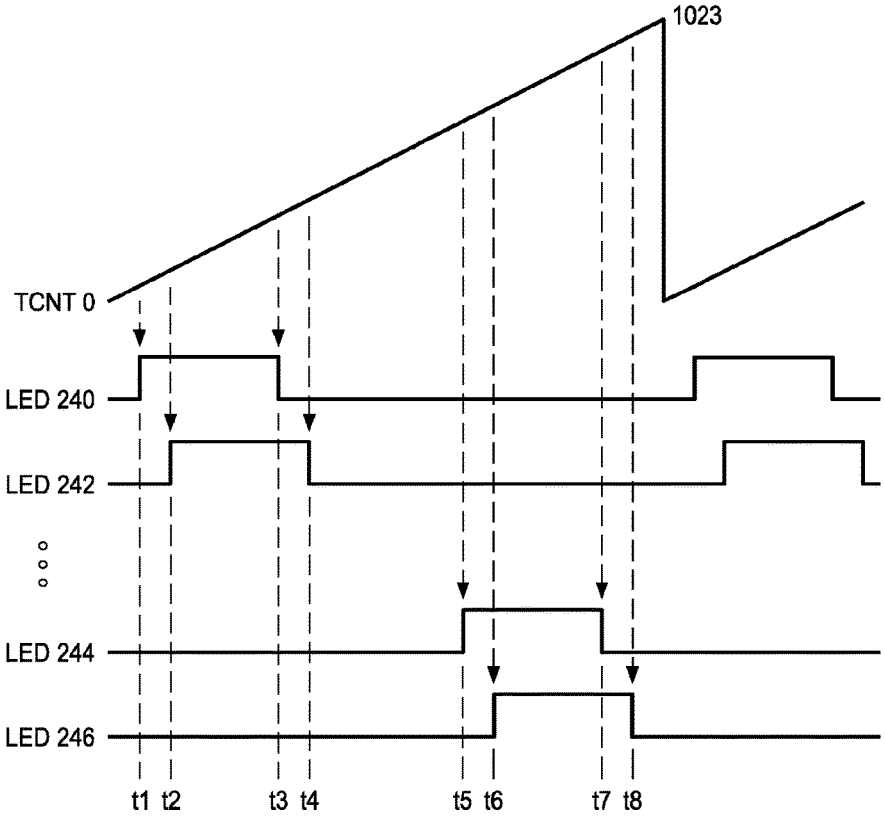
FIG. 6 is a timing diagram showing phased switching of series connected LEDs of FIG. 2.

Referring now to FIG. 6, there is a timing diagram showing phased switching of series connected LEDs 240 through 246 of FIG. 2, where the horizontal axis represents time. By way of example, if a 25% duty cycle is desired for each of LEDs 240 through 246, then each Off register is loaded with a value that is 256 greater than the value for the respective On register. If all series connected LEDs are permitted to turn on or off at once, however, a significant current spike is produced from LED supply voltage VIN. This current spike radiates electromagnetic interference (EMI) that may interfere with nearby electronic devices such as radios, televisions, cordless phones, local area networks, and other electronic devices. In order to avoid this EMI, the present invention advantageously employs phased turn on and turn off of individual LEDs.

In operation, each On register is loaded with a different starting count. For example, the On register corresponding to LED 240 may be loaded with a value of 10 and the On register corresponding to LED 242 may be loaded with a value of 20. For a 25% duty cycle, the Off register corresponding to LED 240 is loaded with a value of 266 and the Off register corresponding to LED 242 is loaded with a value of 276. On and Off register pairs corresponding to LEDs 244 and 246 are loaded in a similar manner with appropriately greater values. PWM counter 400 begins counting with TCNT equal to 0 and incrementally counts to 1023 in response to clock signal CLK. When TCNT reaches 10 at time t1, current flows only through LED 240. When TCNT reaches 20 at time t2, current flows through LED 240 and LED 242. Other LEDs in the series connection (not shown) subsequently turn on when TCNT matches their respective On register values. When TCNT reaches 266, current flow through LED 240 is terminated at time t3. Likewise, when TCNT reaches 276, current flow through LED 242 is terminated at time t4. This procedure continues until current flow through LED 244 begins at time t5 followed by current flow through LED 246 at time t6. Finally, at time t7 and time t8, current flow terminates in LEDs 244 and 246, respectively.

Phased turn on and turn off may be advantageously controlled by independently adjusting either the On register value or the Off register value. The phased turn on and turn off of series connected LEDs 240 through 246 is highly advantageous in preventing current spikes in LED power supply VIN. Elimination of these current spikes permits use of smaller power supply decoupling capacitors. Moreover, the phased turn on and turn off of individual LEDs greatly reduces EMI that might interfere with other nearby electronic devices. Such phased turn on and turn off is simply not possible in series connected LED lighting systems of the prior art.

Figure 7:
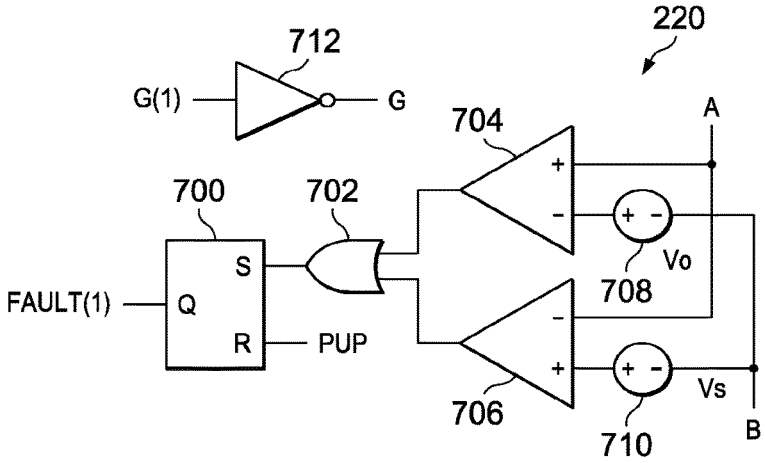
FIG. 7 is a circuit diagram of driver and fault detector circuit 220 of FIG. 2.

Turning now to FIG. 7, there is a circuit diagram of driver and fault detector circuit 220 of FIG. 2. Terminals A, B, and G are respectively connected to terminals A, B, and G of FIG. 2. The fault detector circuit includes SR flip flop 700, OR gate 702, comparator circuits 704 and 706, and reference voltage circuits 708 and 710.

In operation, SR flip flop 700 is initially reset by power up pulse PUP. Power up pulse PUP may be generated by a power up circuit or directed by processor 100 when the light system is activated. Comparator 704 compares the voltage at terminal A to the voltage at terminal B plus reference voltage Vo 708. In the event of an open circuit failure, the voltage across LED 240 is greater than reference voltage Vo, and comparator 704 produces a high output at a first input of OR gate 702. Responsively, the high output of OR gate 702 sets SR flip flop 700 to produce a high level of FAULT(1). Comparator 706 compares the voltage at terminal A to the voltage at terminal B plus reference voltage Vs 710. In the event of a short circuit failure, the voltage across LED 240 is less than reference voltage Vs, and comparator 706 produces a high output at a second input of OR gate 702. Responsively, the high output of OR gate 702 sets SR flip flop 700 and produces a high level of FAULT(1). The high level of FAULT(1) is transmitted to processor 100. Processor 100 sets the respective On and Off register pair to a value that keeps LED 240 off. In order to maintain a constant brightness of the light system, processor 100 updates the On and Off register pairs for the other series connected LED to increase their duty cycle and thereby compensate for the LED fault.

Recall from the discussion of FIG. 4 that a match of the contents of PWM counter 400 with the contents of On register 402 sets SR flip flop 406 to produce a high level of gate signal G(1). Correspondingly, a match of count signal TCNT with the contents of Off register 404 resets SR flip flop 406 to produce a low level of gate signal G(1). The high (on) or low (off) level of gate signal G(1) is applied to inverter 712 through level shift circuit 210. A high level of gate signal G(1), therefore, produces a low level voltage at the gate terminal G of n-channel transistor 230. This low level voltage at terminal G turns off n-channel transistor 230 so that current from voltage supply VIN passes through LED 240. Alternatively, a low level of gate signal G(1) produces a high level voltage at the gate terminal G of n-channel transistor 230. The high level voltage at terminal G turns on n-channel transistor 230. The conductivity of n-channel transistor 230 is sufficient to maintain a drain-to-source voltage that is less the forward bias voltage of LED 240. Thus, n-channel transistor acts as a shunt so that current from voltage supply VIN bypasses LED 240.

This is highly advantageous in maintaining reliable operation of the lighting system even if any one of the series connected LEDs should fail due to an open or short circuit. Moreover, LMM 110 communicates the FAULT(1) signal to processor 100 to identify the failed LED for future replacement.

Figure 8:
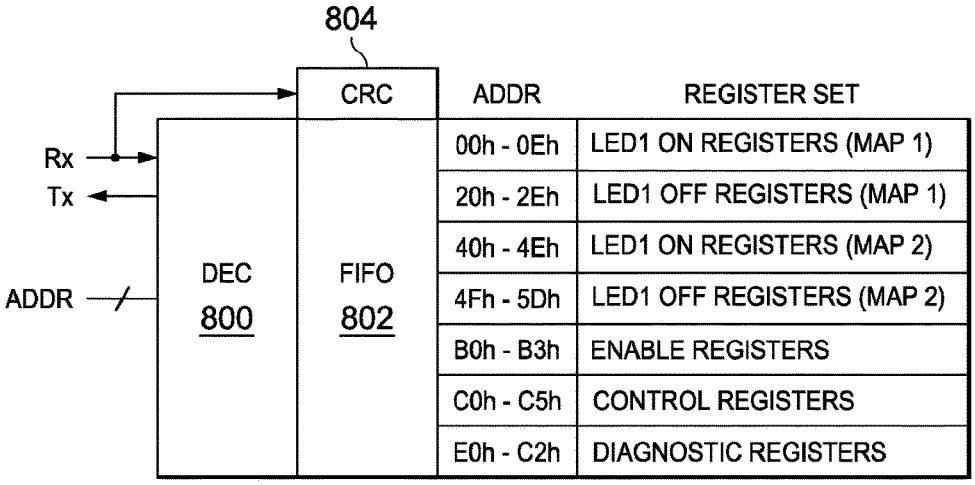
FIG. 8 is a block diagram including the register set of circuit 200 of FIG. 2.

Referring now to FIG. 8, there is a block diagram showing the logic and register set of circuit 200 of FIG. 2. The diagram includes address decoder 800 coupled to first-in first-out (FIFO) register 802. The decoder is coupled to receive register address bits on bus ADDR from processor 100 (FIG. 1). The decoder selectively addresses the FIFO to receive data on bus Rx and to transmit data on bus Tx. A cyclic redundancy check (CRC) circuit 804 is also coupled to receive data on bus Rx and perform a cyclic redundancy check on each received serial data frame. The register set includes LED On and Off registers mapped to the range of addresses (ADDR) indicated as well as enable registers, control registers, and diagnostic registers.

In operation, processor 100 preferably addresses each LMM, for example LMM 110, by the most significant address bits of bus ADDR. If there are eight LMMs in the circuit of FIG. 1, therefore, the three most significant address bits are used to select one of eight LMMs. The remaining address bits of bus ADDR are used to address registers in the logic and registers circuit 200 (FIG. 2). Serial data are transmitted in bytes to FIFO register 802 beginning at the address on bus ADDR. A CRC circuit 804 performs a cyclic redundancy check on the received data frame in the FIFO. If the CRC indicates the data in the FIFO are correct, they are transferred to the input registers. Each received data frame begins with a frame initialization byte (FIB). A first bit of the FIB identifies the data frame as either a response frame or a command frame. Four bits of the FIB are used to specify a particular type of read or write command. This may be a single device read or write command with a variable number of bytes. Alternatively, the four bits may specify a broadcast write to all LMMs of the lighting system. In this case, the three most significant address bits on bus ADDR (FIG. 1) are ignored, and all bytes in the data frame are transmitted to each LMM simultaneously. This is highly advantageous in permitting uniform duty cycle adjustment of all LEDs of the lighting system by selectively writing to the On or Off registers. For a command frame, three remaining bits of the FIB are used to identify a particular LMM address for a single device write, a synchronization command, or a number of bytes in the broadcast write command. For a response frame, the three remaining bits of the FIB determine a number of data bytes to follow.

LED On and Off registers are used to specify when individual LEDs of each series connected string turn on and off, respectively. Enable registers are used to enable specific LEDs of a respective series connected string. For example, if an LED On enable bit is 0, that LED will not change state when TCNT is equal to the respective LED On register value. Alternatively, if the LED On enable bit is 1, that LED will turn on when TCNT is equal to the respective LED On register value. Control registers serve several functions such as loading the PWM counter 400 (FIG. 4) with a respective TCNT value. A system configuration register in the control register group may designate one particular LMM of the lighting system (FIG. 1) as a synchronization master and the remaining LMMs as slaves. In this mode, the LMM synchronization master generates a high level SYNC signal (FIGS. 1-2) for one clock cycle when TCNT reaches 1023. This high level SYNC signal synchronizes all LMM slaves of the lighting system by resetting their respective PWM counters to 0. This advantageously synchronizes PWM counters of all LMMs in the lighting system.

Turning now to FIG. 9A, there is a memory map showing the write sequence of input LED On registers according to the present invention. According to a preferred embodiment of the present invention, both On and Off registers are 10-bit registers. Thus, data bits [7:0] are written to LED1 On register at address 00h, where h indicates a hexadecimal address. Likewise, respective data bits [7:0] are written to LED2 through LED4 On registers at addresses 01h through 03h. A fifth byte having the two most significant data bits [9:8] for each respective LED On register is then written to address 04h. For example, data bits [9:8] of LED4 On register are data bits [7:6] of the fifth byte. Data bits [9:8] of LED3 On register are data bits [5:4] of the fifth byte. Data bits [9:8] of LED2 On register are data bits [3:2] of the fifth byte. Finally, data bits [9:8] of LED1 On register are data bits [1:0] of the fifth byte. In a preferred embodiment of the present invention, there are twelve On registers in each LMM. Thus, the On registers are loaded by writing fifteen data bytes to contiguous addresses 00h through 0Eh. In this case, the memory map of FIG. 9A is repeated twice for contiguous addresses 05h through 0Eh.

Referring next to FIG. 9B, there is a memory map showing the write sequence of input LED Off registers according to the present invention. As with the On registers, data for the Off registers are written as serial byte-wide data and subjected to a CRC check. If the data are correct, they are transferred to the input registers. Data bits [7:0] are written to LED1 Off register at address 20h. Likewise, respective data bits [7:0] are written to LED2 through LED4 Off registers at addresses 21h through 23h. A fifth byte having the two most significant data bits [9:8] for each respective LED Off register is then written to address 24h. For example, data bits [9:8] of LED4 Off register are data bits [7:6] of the fifth byte. Data bits [9:8] of LED3 Off register are data bits [5:4] of the fifth byte. Data bits [9:8] of LED2 Off register are data bits [3:2] of the fifth byte. Finally, data bits [9:8] of LED1 Off register are data bits [1:0] of the fifth byte. In a preferred embodiment of the present invention, there are also twelve Off registers in each LMM. Thus, the Off registers are loaded by writing fifteen data bytes to contiguous addresses 20h through 2Eh. In this case, the memory map of FIG. 9B is repeated twice for contiguous addresses 25h through 2Eh.

Figure 10A:
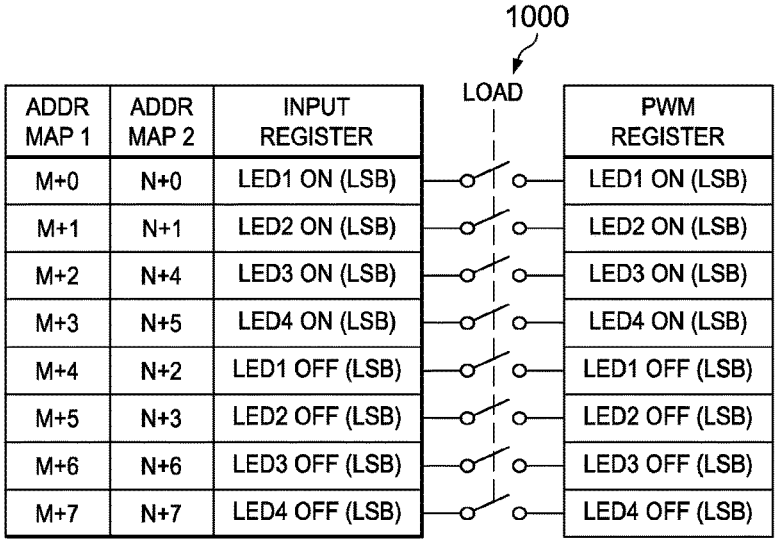
FIG. 10A is a register diagram showing dual memory map addressing and Pulse Width Modulation (PWM) register loading according to one embodiment of the present invention.

Referring now to FIG. 10A, there is a register diagram showing dual memory map addressing and Pulse Width Modulation (PWM) register loading according to one embodiment of the present invention. In a preferred embodiment of the present invention, there are twelve input On and twelve input Off registers as previously discussed with regard to FIGS. 9A and 9B. There are also twelve PWM On and twelve PWM Off registers, which are a copy of the twenty-four input registers. The register diagram of FIG. 10A shows only four On and four Off input and PWM registers for the purpose of illustration. The input registers are coupled to the PWM registers by switching circuits 1000. These switching circuits may be metal oxide semiconductor (MOS) transistors, complementary MOS pass gates, or other suitable switching circuits as are known to those of ordinary skill in the art. According to one embodiment of the present invention, the switching circuits are activated by load command LOAD from processor 100 to simultaneously transfer the contents of the input registers to the PWM registers in a single TCNT clock cycle of PWM counter 400. Address Map 1 on the left side of FIG. 10A shows the least significant bytes (LSB) of LED1 through LED4 On registers are mapped to contiguous memory addresses M+0 through M+3, respectively. Likewise, LSBs of LED1 through LED4 Off registers are mapped to contiguous memory addresses M+4 through M+7, respectively. Here, M is a base address for address map 1. This advantageously permits writing all On registers or all Off registers with a single data frame. For example, all On registers at addresses M+0 through M+3 may be updated while all Off registers at addresses M+4 through M+7 remain unchanged. Thus, the duty cycle of each LED in an LMM may be increased or decreased in a single write transaction.

Address Map 2 on the left side of FIG. 10A shows that LSBs of LED1 through LED2 On registers and LED1 through LED2 Off registers are mapped to contiguous memory addresses N+0 through N+3, respectively. Here, N is a base address for address map 2. Likewise, LSBs of LED3 through LED4 On registers and LED3 through LED4 Off registers are mapped to contiguous memory addresses N+4 through N+7, respectively. This advantageously permits writing selected On and Off registers simultaneously. For example, the phase shift of LED1 and LED2 may be changed with respect to LED3 and LED4 in a single write transaction without changing the duty cycle. Thus, the phase shift of each LED in an LMM or in multiple LMMs may be increased or decreased in a single write transaction without changing the respective LED duty cycle.

Figure 10B:
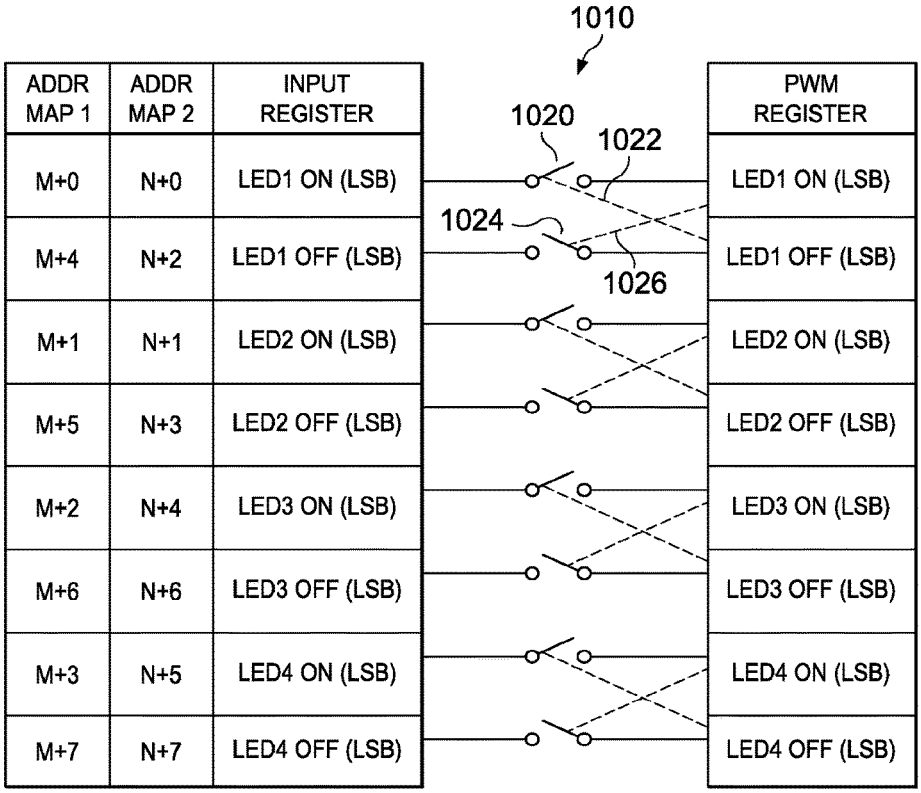
FIG. 10B is a register diagram showing dual memory map addressing and Pulse Width Modulation (PWM) register loading according to another embodiment of the present invention.

Referring now to FIG. 10B, there is a register diagram showing dual memory map addressing and Pulse Width Modulation (PWM) register loading according to another embodiment of the present invention. The register diagram of FIG. 10B shows only four On and four Off input and PWM registers for the purpose of illustration. The On and Off input registers are memory mapped in the same manner as previously described with respect to FIG. 10A but are rearranged to show a different PWM loading circuit. The input registers are coupled to the PWM registers by switching circuits 1010. These switching circuits may be metal oxide semiconductor (MOS) transistors, complementary MOS pass gates, or other suitable switching circuits as are known to those of ordinary skill in the art. The dashed lines of the switching circuits indicate control signals when a match is detected between TCNT and a respective On or Off PWM register as previously described with regard to FIG. 4. For example, switch 1020 transfers the contents of LED1 On input register into LED1 On PWM register when TCNT matches a value in LED1 Off PWM register in response to control signal 1022. This is preferably the same control signal that resets SR flip flop 406 of FIG. 4. Likewise, switch 1024 transfers the contents of LED1 Off input register into LED1 Off PWM register when TCNT matches a value in LED1 On PWM register in response to control signal 1026. This is preferably the same control signal that sets SR flip flop 406 of FIG. 4. Contents of other input registers are transferred into respective PWM registers in a similar manner. This embodiment of the present invention advantageously permits writing all On registers or all Off registers sequentially in response to individual match signals, thereby avoiding any sudden change in illumination or power consumption of the lighting system.

Still further, while numerous examples have thus been provided, one skilled in the art should recognize that various modifications, substitutions, or alterations may be made to the described embodiments while still falling within the inventive scope as defined by the following claims. For example, although PWM counter 400 of FIG. 4 is a 10-bit incrementing counter, other embodiments of the present invention envision a decrementing counter with any suitable bit count. In this case, the sense of On register 402 and Off register 404 is simply reversed. Other combinations will be readily apparent to one of ordinary skill in the art having access to the instant specification.

What is claimed is:

1. A register circuit, comprising:

a first set of addressable registers comprising a first subset, the first subset of registers comprising On registers of a light emitting diode (LED) light system and a second subset of registers, the second subset of registers comprising Off registers of the light emitting diode (LED) light system;

a logic circuit arranged to select only the first subset in response to a first sequence of K address signals, where K is a positive integer; and the logic circuit arranged to select a first part of the first subset and a first part of the second subset in response to a second sequence of K address signals.

2. A light system as in claim 1, wherein a value in each On register determines when a respective LED turns on, and wherein a value in at least one Off register determines when the respective LED turns off.

3. A register circuit as in claim 1, comprising:

a second set of registers comprising a same number of registers as the first set of addressable registers; and a switching circuit coupled between the first set of addressable registers and the second set of registers and arranged to transfer the contents of the first set of addressable registers to the second set of registers in response to a load signal.

4. A register circuit as in claim 3, wherein the first set of addressable registers comprises input registers, and wherein the second set of registers comprises pulse width modulation (PWM) registers.

5. A register circuit as in claim 1, comprising:

a second set of registers comprising a same number of registers as the first set of addressable registers; and a switching circuit coupled between the first set of addressable registers and the second set of registers and arranged to transfer the contents of each register of the first set of addressable registers to a corresponding register of the second set of registers in response to a respective load signal.

6. A method of operating a light emitting diode (LED) light system, comprising:

writing data in a first set of registers, each register of the first set arranged to operate a respective LED of a first plurality of series connected LEDs;

writing data in a second set of registers, each register of the second set arranged to operate the respective LED of the first plurality of series connected LEDs;

incrementing a count in a first counter in response to a clock signal;

turning on each respective LED when a register of the first set matches a respective count of the first counter; and turning off each respective LED when a register of the second set matches a respective count of the first counter.

7. A method as in claim 6, comprising:

writing data in the first set of registers so that each respective LED turns on in response to a different count of the first counter; and writing data in the second set of registers so that each respective LED turns off in response to a different count of the first counter.

8. A method as in claim 6, comprising writing data in each register of the first and second sets of registers in a single clock cycle of the clock signal.

9. A method as in claim 6, comprising writing data in each register of only the first set of registers in a single clock cycle of the clock signal.

10. A method as in claim 6, comprising writing data in each register of only the second set of registers in a single clock cycle of the clock signal.

11. A method as in claim 6, comprising controlling a duty cycle of each LED of the first plurality of series connected LEDs by a difference between the data stored in each respective register of the first set of registers and the data stored in each respective register of the second set of registers.

12. A method as in claim 6, comprising:

writing data in a third set of registers, each register of the third set arranged to operate a respective LED of a second plurality of series connected LEDs;

writing data in a fourth set of registers, each register of the fourth set arranged to operate the respective LED of the second plurality of series connected LEDs;

incrementing a count in a second counter in response to the clock signal;

turning on each respective LED when a register of the third set matches a respective count of the second counter; and turning off each respective LED when a register of the fourth set matches a respective count of the second counter.

13. A method as in claim 12, comprising synchronizing the first and second counters in response to a synchronization signal.

* * * * *